US007591312B2

(12) United States Patent
Johnson et al.

(10) Patent No.: US 7,591,312 B2
(45) Date of Patent: Sep. 22, 2009

(54) COMPLETION METHOD FOR FRACTURING AND GRAVEL PACKING

(75) Inventors: Michael H. Johnson, Katy, TX (US); Douglas J. Murray, Magnolia, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 161 days.

(21) Appl. No.: 11/757,885

(22) Filed: Jun. 4, 2007

(65) Prior Publication Data

US 2008/0296019 A1 Dec. 4, 2008

(51) Int. Cl.
*E21B 43/04* (2006.01)
*E21B 43/26* (2006.01)

(52) U.S. Cl. ..... 166/278; 166/51; 166/308.1

(58) Field of Classification Search ..... 166/51, 166/278, 305.1, 308.1
See application file for complete search history.

(56) References Cited

U.S. PATENT DOCUMENTS

| | | | | |
|---|---|---|---|---|
| 2,775,304 | A | 12/1956 | Zandmer | |
| 2,855,049 | A | 10/1958 | Zandmer | |
| 3,326,291 | A | 6/1967 | Zandmer | |
| 3,347,317 | A | 10/1967 | Zandmer | |
| 3,358,770 | A | 12/1967 | Zandmer | |
| 3,924,677 | A | 12/1975 | Prenner et al. | |
| 4,285,398 | A | 8/1981 | Zandmer et al. | |
| 4,506,734 | A | 3/1985 | Nolte | |
| 5,379,838 | A | 1/1995 | Wilson et al. | |
| 5,439,055 | A | 8/1995 | Card et al. | |
| 5,588,487 | A | 12/1996 | Bryant | |
| 5,775,425 | A | 7/1998 | Weaver et al. | |
| 5,829,520 | A | 11/1998 | Johnson | |
| 6,016,870 | A | 1/2000 | Dewprashad et al. | |
| 6,047,772 | A | 4/2000 | Weaver et al. | |
| 6,059,033 | A * | 5/2000 | Ross et al. | 166/278 |
| 6,069,118 | A | 5/2000 | Hinkel et al. | |
| 6,209,643 | B1 | 4/2001 | Nguyen et al. | |
| 6,330,916 | B1 | 12/2001 | Rickards et al. | |
| 6,406,789 | B1 | 6/2002 | McDaniel et al. | |
| 6,435,277 | B1 | 8/2002 | Qu et al. | |

(Continued)

FOREIGN PATENT DOCUMENTS

WO 2005100743 A1 10/2005

OTHER PUBLICATIONS

Vickery, Harold, et al., "One-Trip Multizone Frac Packs in Bohai Bay—A Case Study in Efficient Operations", IADC/SPE 88023, Sep. 2004, 1-10.

(Continued)

*Primary Examiner*—Giovanna C Wright
(74) *Attorney, Agent, or Firm*—Steve Rosenblatt

(57) ABSTRACT

In one embodiment telescoping members are extended to bridge an annular gap either before or after it is cemented. Some of the telescoping members have screens and others have flow passages that can be selectively opened with associated valves to frac an interval in any order desired. The valves are then closed after the frac job and the other telescoping members are made to allow screened flow from the fractured formation. In another embodiment an interval to be gravel packed and fractured has a series of screens and selectively opened valves on a bottom hole assembly such as a liner. One or more external packers are provided. The entire interval is gravel packed at one time followed by packer actuation and then selective opening of ports to conduct a fracture operation in any of the zones defined by the set packers and in any desired order.

17 Claims, 6 Drawing Sheets

U.S. PATENT DOCUMENTS

| | | | | |
|---|---|---|---|---|
| 6,439,309 | B1 | 8/2002 | Matherly et al. | |
| 6,582,819 | B2 | 6/2003 | McDaniel et al. | |
| 6,599,863 | B1 | 7/2003 | Palmer et al. | |
| 6,637,517 | B2 | 10/2003 | Samuel et al. | |
| 6,675,893 | B2 * | 1/2004 | Lund | 166/278 |
| 6,938,693 | B2 | 9/2005 | Boney et al. | |
| 2003/0019627 | A1 | 1/2003 | Qu et al. | |
| 2003/0062160 | A1 | 4/2003 | Boney et al. | |
| 2005/0006095 | A1 | 1/2005 | Justus et al. | |
| 2005/0011648 | A1 | 1/2005 | Nguyen et al. | |
| 2005/0274523 | A1 | 12/2005 | Brannon et al. | |
| 2007/0042913 | A1 | 2/2007 | Hutchins et al. | |
| 2008/0066900 | A1 * | 3/2008 | Saebi et al. | 166/51 |

OTHER PUBLICATIONS

Vickery, Harold, et al., "One-Trip Multizone Frac Packs in Bohai Bay—A Case Study in Efficient Operations", ISPE 90173, Sep. 2004, 1-10.

Vickery, Harold, et al., "New One-Trip Multi-zone Frac Pack System with Positive Positioning", SPE 78316, Oct. 2002, 1-8.

* cited by examiner

COMPLETION METHOD FOR FRACTURING AND GRAVEL PACKING

FIELD OF THE INVENTION

The field of the invention is completion techniques and more particularly those that involve gravel packing and fracturing with a means of preventing proppant flow back and/or formation solids production such as a screen assembly in position.

BACKGROUND OF THE INVENTION

Fracturing involves high flow rates and pressures to open up a formation using specialized fluids for the task. Typically after enough fluid volume at high enough pressure to fracture the formation is pumped, proppant is then added to the fracture fluid to enter the fractures just made and hold them open for subsequent production. In some applications, a screen assembly is introduced or is already in the well when the fracturing occurs. The fracturing process then transitions into a gravel packing process to allow proppant to fill the screen/casing annulus thus completing the gravel pack portion of a frac packed completion. When the proppant is introduced below an isolation packer for a given interval in a zone, it crosses over into the annulus surrounding the screens so that it can enter the fractures as well as fill the annular space around the screen assembly before production. The proppant is delivered into the fractures at high pressures and injection rates. The pump rates are reduced and circulation allowed to occur in order to fill the annulus between the screen and casing to complete the gravel pack.

In the past, fracturing and gravel packing of very long zones or multiple zones, whether in open hole or in cased hole typically required intermediate isolation packers to subdivide the interval into smaller zones to focus the fracturing or the gravel packing into such subdivided zones. This was time consuming and expensive because it required more packers, generally more trips in the well bore to facilitate equipment placement, and forced the same operation to be repeated numerous times to properly prepare an entire interval for subsequent production.

What is needed and provided by the present invention is a way to gravel pack the entire screened interval in a single operation in cased or open hole and then still have the ability to isolate intervals within a gravel packed zone for fracturing in a desired order through selectively opened ports in a liner. Another need addressed by the invention uses telescoping members that can be extended so that an annular space can be bridged by them while a liner is cemented, for example. Some of the telescoping members can be subsequently used for production. Some telescoping members in a liner can be associated with a valve and selectively opened in any desired order for a fracturing operation localized to the region around the telescoping members with its associated valve being opened. Production can then take place through the telescoping members with screens built into them while the other telescoping members that were used for fracturing have their associated valves closed.

Telescoping members have been in use to provide formation access after an annular space is cemented. These members have been equipped with either rupture discs or some other blocking material that can disappear such as by chemical interaction to open up a passage for flow after extension and cementing of the surrounding annulus. A good example of this is U.S. Pat. No. 5,829,520 as well as the various Zandmer patents cited in that patent. Gravel packing with zone isolation already in place in combination with bypass tubes to let the gravel get past such set barriers is shown in U.S. Pat. No. 5,588,487.

The preferred embodiment of the present invention will illustrate exemplary concepts of completions involving cementing and fracturing with a possible use of gravel packing in a procedure that optimizes the completion to allow it to get done faster and in a more cost effective manner. These and other advantages will become more readily apparent from a review of the description of the preferred embodiment and the associated drawings while recognizing that the appended claims define the full scope of the invention.

SUMMARY OF THE INVENTION

In one embodiment telescoping members are extended to bridge an annular gap either before or after it is cemented. Some of the telescoping members have screens and others have flow passages that can be selectively opened with associated valves to frac an interval in any order desired. The valves are then closed after the frac job and the other telescoping members are made to allow screened flow from the fractured formation. In another embodiment an interval to be gravel packed and fractured has a series of screens and selectively opened valves on a bottom hole assembly such as a liner. One or more external packers are provided. The entire interval is gravel packed at one time followed by packer actuation and then selective opening of ports to conduct a fracture operation in any of the zones defined by the set packers and in any desired order.

DETAILED DESCRIPTION OF THE PREFERRED EMBODIMENT

Figure 1:
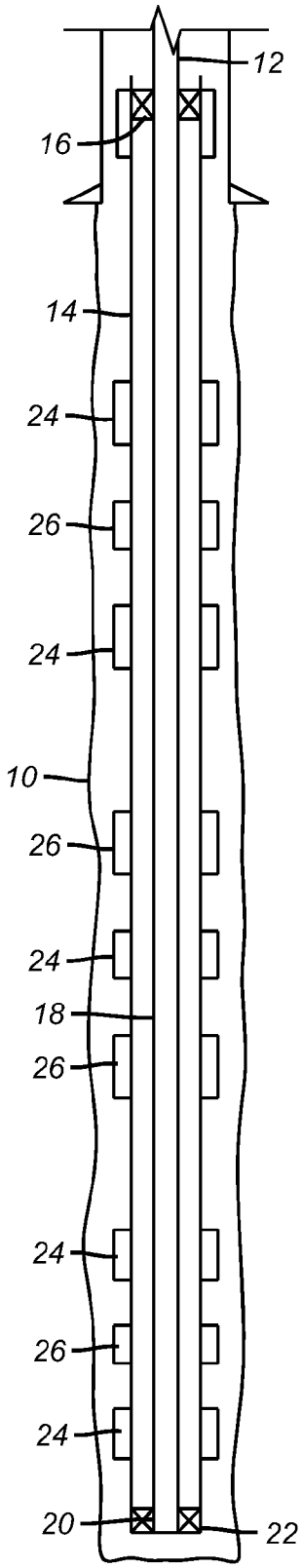
FIG. 1 is a section view of a bottom hole assembly in position in an open hole.
Figure 5:
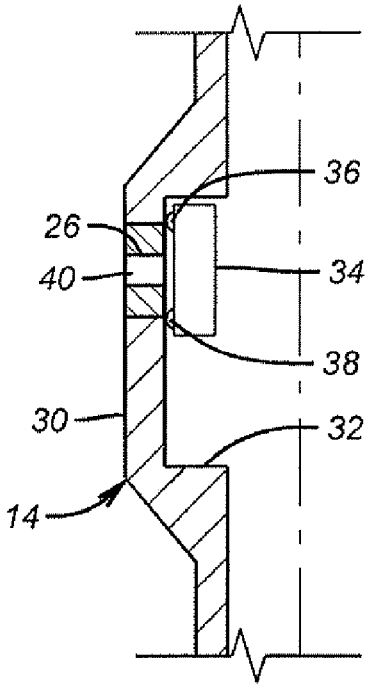
FIG. 5 shows the sliding sleeve valve of FIG. 4 in the closed position before the piston is telescoped.
Figure 6:
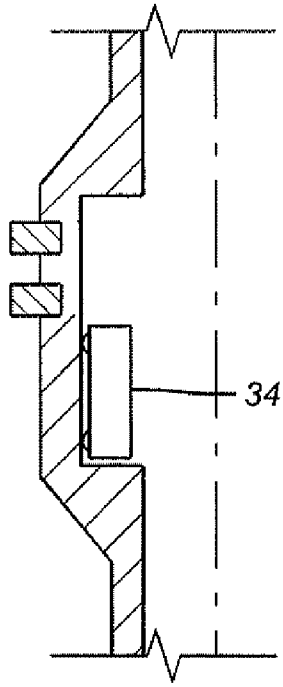
FIG. 6 is the view of FIG. 5 with the sliding sleeve valve open and the piston telescoped out.
Figure 7:
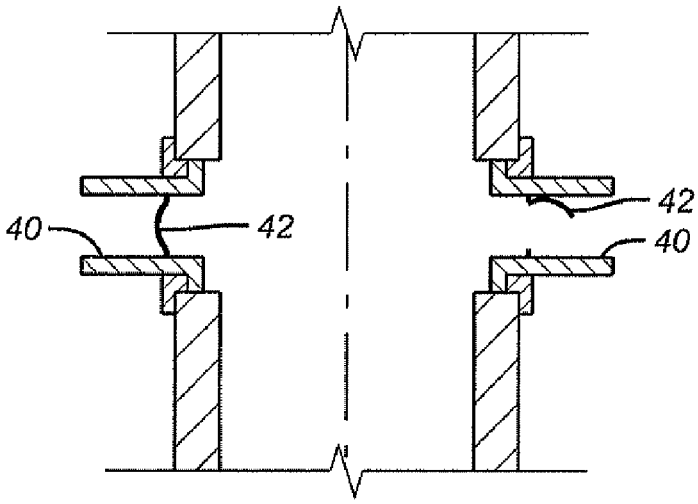
FIG. 7 is a split view showing the telescoping piston in more detail with a barrier intact on the left and the barrier ruptured with the piston extended on the right.

FIG. 1 shows an open hole 10 with a surface string 12 supporting a liner 14 through a running tool 16. String 12 extends through the running tool 16 to form an inner string 18 within the liner 14. Inner string 18 terminates in a seal bore 20 located at the lower end 22 of the liner 14. Liner 14 features telescoping members 24 and 26 shown in an alternating pattern although other patterns are possible as are different spacing and different total counts. The members 24 are preferably initially sealed with a material that can later be removed to expose a flow passage that contains a screen 28 or equivalent device to hold back solids when the formation is put onto production. Members 26 are shown in more detail in FIG. 5. There they are in the retracted position for run in so as not to significantly extend beyond outer surface 30. Within the liner 14 in a recess 32 is located a slide valve 34 with seals 36 and 38 to selectively block access to passage 40 in member 26. FIG. 6 illustrates the open position of slide valve 34. In this position, pressure within the liner 14 make members 24 and 26 extend radially. On reason this happens is shown in the split view of FIG. 7. Even after the initial opening of valves 34 with a shifting tool (not shown) each of their passages 40 is still covered such as with a rupture disc or equivalent removable barrier that can be removed with pressure or by other techniques such as chemical reaction or temperature exposure over time, for example. The other portion of FIG. 7 shows the member 26 with passage 40 clear for flow and the obstruction member 42 disabled. The design of the telescoping members will not be explored in great detail as they are known devices whose application is described in U.S. Pat. No. 5,829,520 and the patents to Zandmer cited therein.

Figure 2:
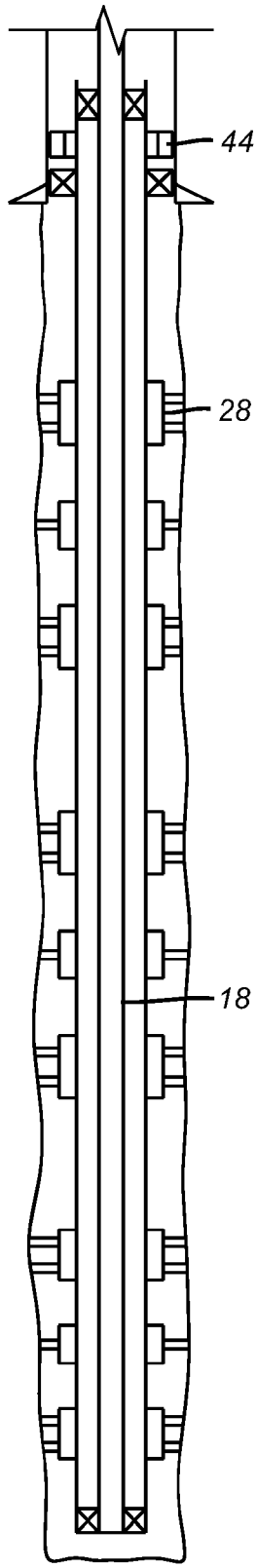
FIG. 2 is the view of FIG. 1 with the telescoping members extended.
Figure 3:
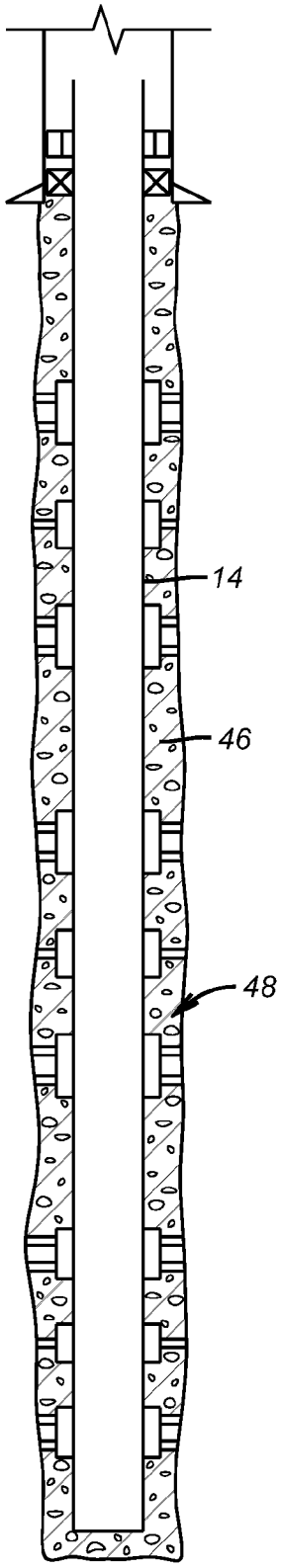
FIG. 3 is the view of FIG. 2 with the annulus cemented.

Now referring back to FIG. 2, the valves 34 shown in FIG. 6 are in the open position to allow access to members 26 when the liner 14 is pressurized. The hanger 44 is set to support the liner 14. There is always pressure access from within the liner 14 to members 24 although their passages are internally obstructed, initially, to allow pressure to telescope them out to the borehole wall 10. Seal bore 20 can be part of a float shoe of a type known in the art to allow cement 46 to be pumped into annulus 48 and keep it from coming back into liner 14 through a check valve, not shown. After the cement 46 is pumped, the string 12 is raised and pressure is applied to pressurize the liner 14 internally and to telescope out all the members 24 and 26. At this point the fact that flow passages 28 and 40 are obstructed allows the members to respond to internal pressure in the liner 14 and telescope out radially. Upon getting extension of members 24 and 26 the obstructions in passages 40 can be removed by pressure, chemicals, temperature exposure or other ways to allow access past the cement 46 and into the formation 50 that surrounds the cement 46.

Figure 4:
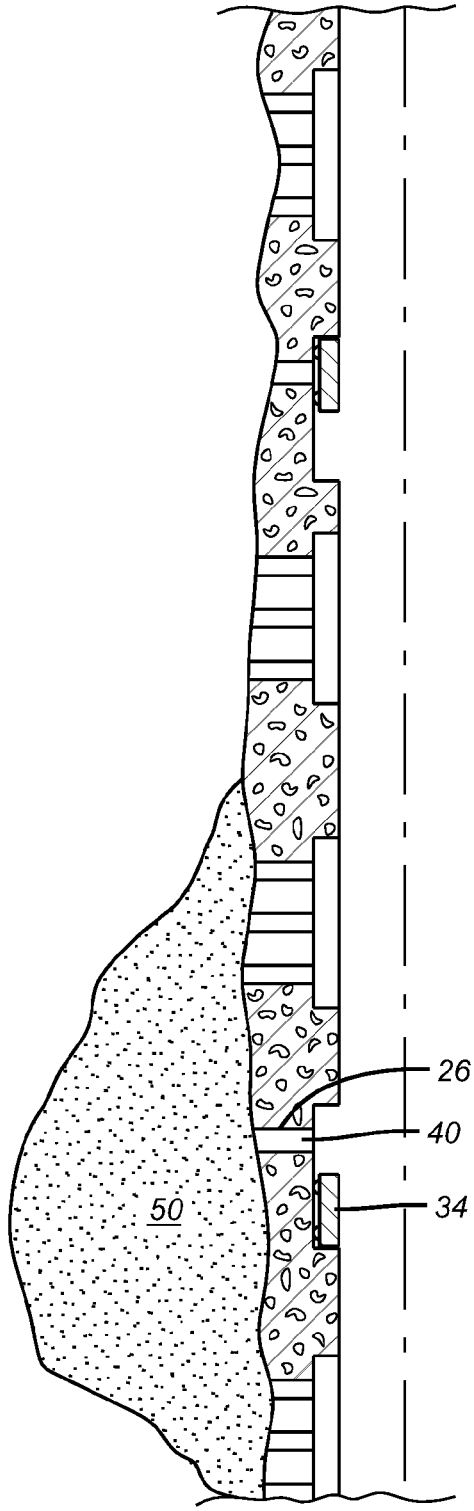
FIG. 4 is the view of FIG. 3 with a sliding sleeve opened to one of the telescoping members to allow fracturing to take place through it.

FIG. 4 shows one valve 34 then moved into the open position to allow flow from within the liner 14 through the member 26 that now has an opened passage to the formation 50. The valves 34 can be opened in any order so as to allow fracturing through members 26 in any order with the members 24 extended but not open at passages 28 so as to allow pressure developed in liner 14 to be directed to the member or members 26 with an associated valve 34 in the open position. When the fracturing through the desired members 26 is completed, the valves 34 are all put in the closed position and the passages 28 in members 24 are ready to be opened. This can be accomplished by pressure, chemicals or time exposure to temperature or other ways so as to expose the passages 28 that preferably include a screen device to hold back some of the solids that may be produced when production begins through members 28.

Figure 8:
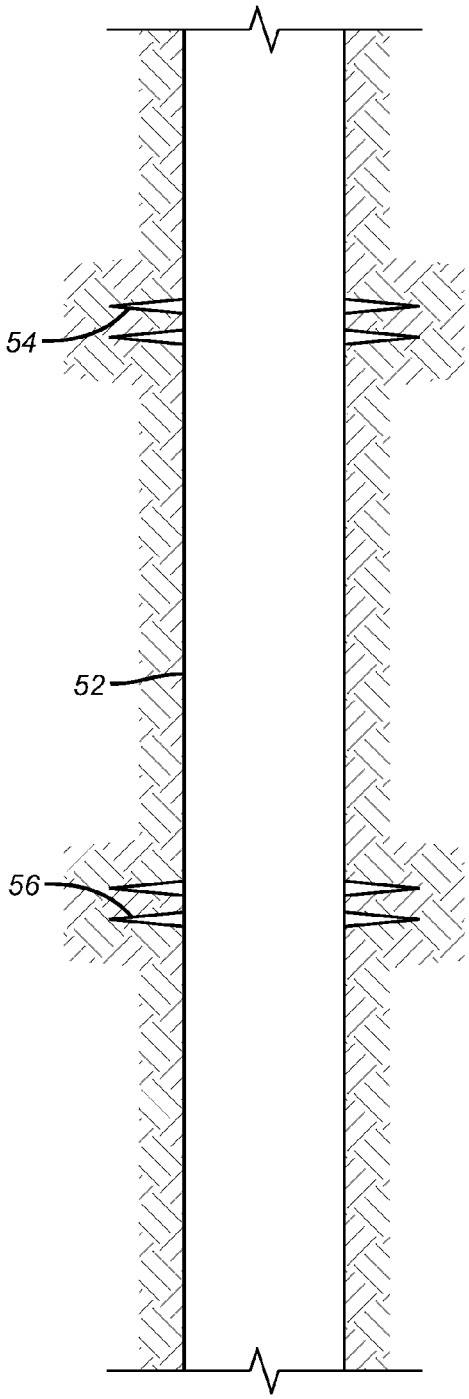
FIG. 8 shows a cased and cemented and perforated wellbore.
Figure 9:
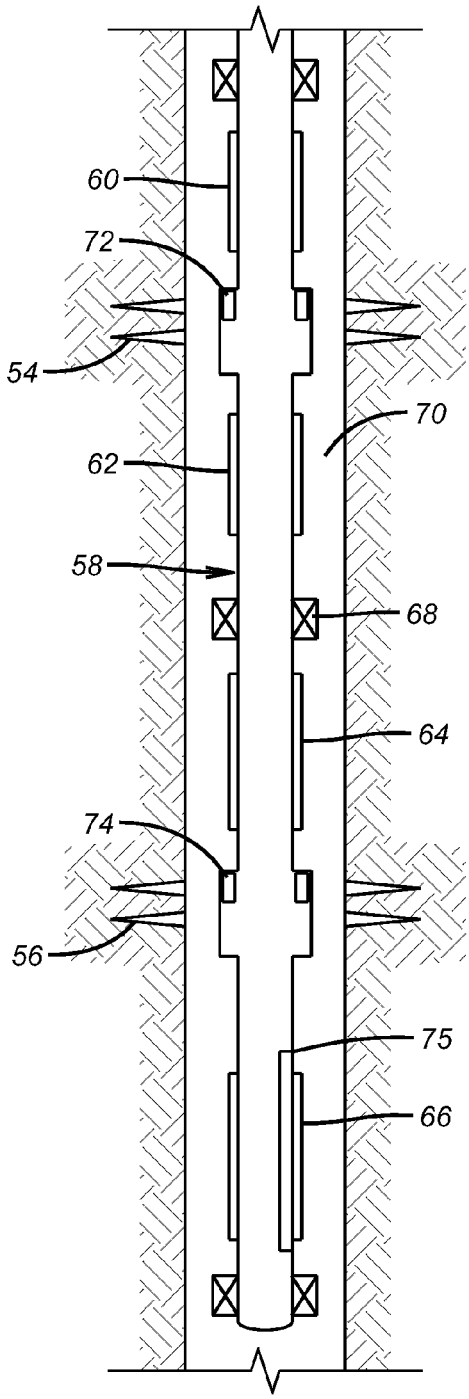
FIG. 9 is the view of FIG. 8 showing a bottom hole assembly in position that includes screens and ports with valves and an external packer in the unset position.
Figure 10:
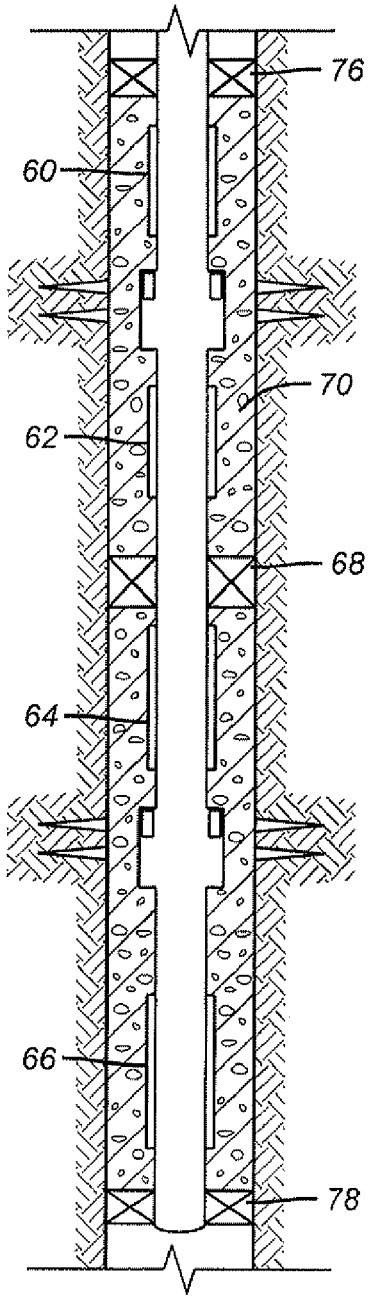
FIG. 10 is the view of FIG. 9 with the entire interval gravel packed and the packer then set.

FIG. 8 shows a completion technique that starts with a cased hole 52 that has perforations at 54 and 56. In FIG. 9, a bottom hole assembly 58 has a series of screens for example 60 and 62 separated from screens 64 and 66 by a barrier device than can be actuated such as a packer 68. The number of screens and packers can be varied as can their spacing. The packer or packers used such as 68 are provided to eventually close off the annulus 70 after it is gravel packed as shown in FIG. 10. The assembly 58 further comprises valved ports 72 and 74 that straddle the packer 68. Ideally, one or more valved ports should be present to provide access into the annulus 70 on either side of a packer 68 where ultimately there will be a need to fracture or produce well fluids. FIG. 10 also shows a top packer 76 that is set in conjunction with a known crossover, not shown, to allow deposition of gravel to the entire interval below packer 76 in one operation. Tubes to allow gravel pass any sand bridges can also be used according to methods well known in the art to promote gravel distribution. Ports 72 and 74 are closed during the gravel packing of the annular space 70.

Figure 11:
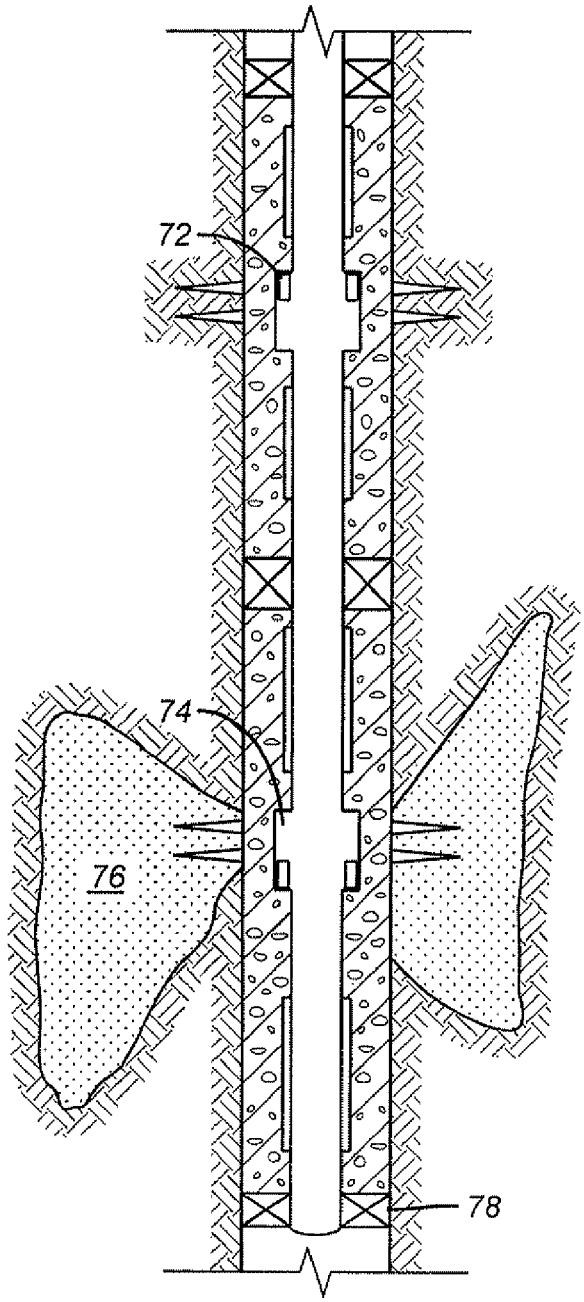
FIG. 11 is the view of FIG. 10 with one of the valved ports open for a frac job.

FIG. 11 shows how a valve 74 can be opened while valve 72 is closed, for example. With the packer 68 already set, pressure in the assembly 58 can fracture sub zone 76 adjacent open valve 74. The fracturing can be in any order that the valves such as 72 and 74 are operated. An anchor packer 78 can be used to close off the wellbore below the assembly 58.

Figure 12:
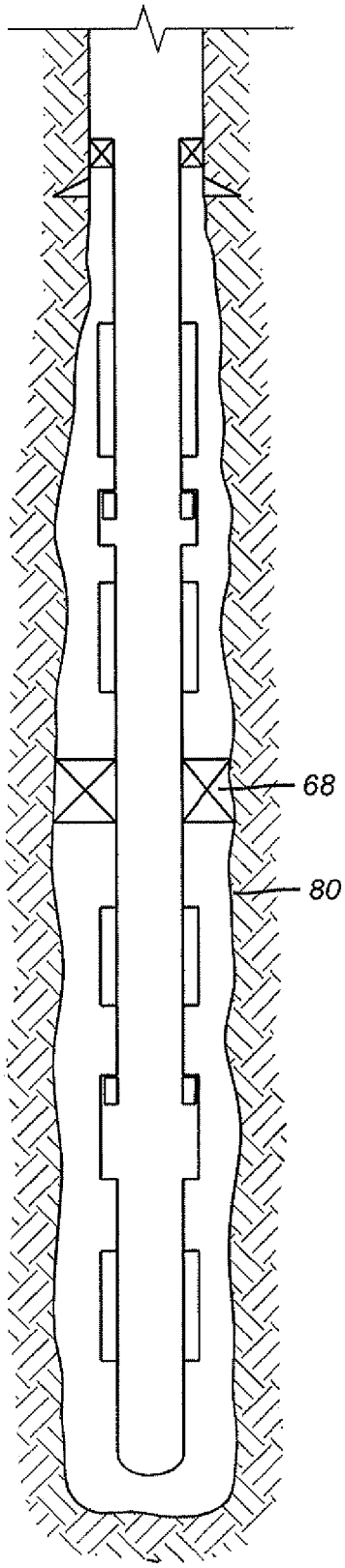
FIG. 12 is an alternative to FIG. 9 showing the bottom hole assembly in an open hole application as opposed to a cased hole.

FIG. 12 simply illustrates that the concept of FIGS. 9-11 can be used in open hole 80 with the same operational sequence and possibly leaving out the anchor packer 78.

Those skilled in the art will now appreciate that the technique of FIGS. 1-7 illustrates an ability to position a liner with formation access without perforation. The liner or tubular 14 can be cemented before or after extension of the members 24 and 26. The array of members 24 and 26 allows fracturing to take place in any order that valves 34 are operated with known shifting tools or the like. While sliding sleeves are preferred for valves 34 other types that can be opened and closed when needed can be used. The option to fracture before going on production improves the production rate. The array of telescoping members allows opening of the production passages 28 that also preferably contain a screen assembly after the fracturing is completed in the desired sequence. The valves 34 are closed and the members 24 cleared for production flow through a discrete set of passages from those that were used to fracture. The passages 40 are preferably unobstructed and are made from materials that will resist high fluid velocity erosion during the fracturing operation. As previously stated, members 26 on the other hand preferably have screens in passages 28 to stop at least some produced solids from getting into the liner 14.

The method described in FIGS. 8-12 shows a completion technique that allows gravel packing an interval at once that will also be fractured in smaller increments. The presence of the set packer such as 68 in the annulus 70 can be useful in later isolation of portions of the producing zone such as for example if a portion starts to produce water. The screens in that subpart can be closed off using a schematically illustrated valve 75 and production can continue from adjacent screens without concern of axial migration of the contaminant such as water. Here again, the method allows for one gravel pack for the overall interval, an opportunity to subdivide the annulus after gravel packing with known packers followed by fracturing in any desired sequence. It should be noted that packers such as 68 are mounted on blank pipe and that during gravel deposition typically the gravel doesn't tend to pack tightly in the annulus 70 during a gravel pack. This makes it less difficult to set the packer 68 after the gravel packing is complete. The method works in cased or open hole. The method can be accomplished in a single trip when the assembly is run in with a shifting tool to operate the valves 72 or 74. The topmost zone to be fractured can also be accessed through the crossover instead of a valved port such as 72 but the valved ports are preferred because they accommodate the higher flow rates and velocities seen during a fracturing operation.

The above description is illustrative of the preferred embodiment and various alternatives and is not intended to embody the broadest scope of the invention, which is determined from the claims appended below, and properly given their full scope literally and equivalently.

We claim:

1. A completion method, comprising:

running in a bottom hole assembly comprising at least two screen sections, at least one valved port adjacent at least one of said screens for selective communication between internally and externally of a string comprising said screen sections and at least one external isolator between said screens;

positioning said assembly adjacent an interval to be produced;

gravel packing an annular space to cover said screen sections;

subdividing said annular space after said gravel packing with said external isolator whose actuation sealingly isolates portions of said annular space disposed on opposed sides of said isolator; and fracturing through said valved port after said subdividing.

2. The method of claim 1, comprising:

positioning said external isolator between said screen sections.

3. The method of claim 2, comprising:

positioning at least one valved port for access to each subdivided space.

4. The method of claim 3, comprising:

fracturing through one said valved port at a time.

5. The method of claim 4, comprising:

using said external isolator to prevent flow in said annular space along said bottom hole assembly between subdivided zones.

6. The method of claim 5, comprising:

closing all valved ports before producing into said screens.

7. The method of claim 6, comprising:

closing off a screen when undesired fluids are produced through it.

8. The method of claim 7, comprising:

continuing to produce from a different screen after said closing off.

9. The method of claim 8, comprising:

running said assembly into cased hole.

10. The method of claim 8, comprising:

running said assembly into open hole.

11. The method of claim 3, comprising:

fracturing through more than one said valved port at a time.

12. The method of claim 1, comprising:

running said assembly into cased hole.

13. The method of claim 1, comprising:

running said assembly into open hole.

14. The method of claim 1, comprising:

using said external isolator to prevent flow in said annular space along said bottom hole assembly between subdivided zones.

15. The method of claim 1, comprising:

closing all valved ports before producing into said screens.

16. The method of claim 1, comprising:

closing off a screen when undesired fluids are produced through it.

17. The method of claim 16, comprising:

continuing to produce from a different screen after said closing off.

* * * * *